United States Patent [19]

Vanhorebeek et al.

[11] 4,327,988

[45] May 4, 1982

[54] APPARATUS FOR TREATING PHOTOGRAPHIC MATERIALS

[75] Inventors: Remi Vanhorebeek, Itegem, Belgium; Erwin Geyken, Neubiberg, Fed. Rep. of Germany; Peter Mayer, Munich, Fed. Rep. of Germany; Helmut Schausberger, Munich, Fed. Rep. of Germany; Rudolf Brünner, Munich, Fed. Rep. of Germany

[73] Assignee: AGFA-Gevaert Aktiengesellschaft, Leverkusen, Fed. Rep. of Germany

[21] Appl. No.: 262,615

[22] Filed: May 11, 1981

[30] Foreign Application Priority Data

May 10, 1980 [DE] Fed. Rep. of Germany ..... 3017946

[51] Int. Cl.[3] ..... G03D 3/02

[52] U.S. Cl. ..... 354/320; 354/324; 134/122 P

[58] Field of Search ..... 354/319, 320, 321, 322, 354/324, 331; 134/64 P, 122 P

[56] References Cited

U.S. PATENT DOCUMENTS

| | | | |
|---|---|---|---|
| 3,774,521 | 11/1973 | Beck | 354/324 X |
| 3,988,756 | 10/1976 | Wick et al. | 354/319 |
| 4,023,190 | 5/1977 | Fassler | 354/324 X |
| 4,101,919 | 7/1978 | Ammann | 354/324 X |
| 4,187,023 | 2/1980 | Schausberger et al. | 354/324 X |

*Primary Examiner*—L. T. Hix
*Assistant Examiner*—Alan Mathews
*Attorney, Agent, or Firm*—Kontler & Grimes

[57] ABSTRACT

An apparatus for wet treatment of sheets or strips of photographic material has a small-volume treating chamber bounded by pairs of advancing rollers at its inlet and outlet ends. A lower wall of the chamber extends between the lower rollers of the pairs of advancing rollers and sealing lips bridge the gaps between such lower wall and the respective lower rollers. Treating liquid is admitted laterally into the chamber, transversely of the path of advancement of photographic material and at about the level of such path.

11 Claims, 2 Drawing Figures

APPARATUS FOR TREATING PHOTOGRAPHIC MATERIALS

BACKGROUND OF THE INVENTION

The present invention relates to wet treatment of photographic materials, such as sheets or webs of photographic film or paper.

Conventional apparatus for wet treatment of photographic material have treating chambers through which the photographic material advances along a horizontal path. Pairs of advancing rollers are provided at the upstream and downstream ends of the chamber and the treating liquid is pumped into the interior of the chamber. As a rule, the chamber is a plenum chamber into which the treating liquid is admitted at a high speed through small openings. A drawback of such prior art apparatus is that even slight fluctuations in the quantities of liquid pumped per unit of time will result in inadequate liquid pressure so that the photographic material will undergo a non-uniform treatment.

According to another prior proposal, the treating chamber is subdivided into a main chamber and two end chambers each of which accommodates one of the pairs of advancing rollers. The dividers between the chambers have portions which are shaped to cooperate with the advancing rollers so as to make the main chamber as fluidtight as possible. This causes the liquid bath in the main chamber to rise to a level above the plane of the advancing photographic material. Although this concept is basically advantageous, it has been found that the apparatus is too complicated. Also, the treating liquid is admitted at the bottom of the main chamber which induces a liquid flow that is different with reference to the two major surfaces of the photographic material. This can result in non-uniform developing, especially of X-ray films.

OBJECTS AND SUMMARY OF THE INVENTION

An object of the invention is to provide an apparatus for wet treatment of photographic materials whose developing action is superior to that of conventional apparatus.

Another object of the invention is to provide a simple, inexpensive, compact and rugged apparatus for wet treatment of photographic paper, films or the like.

An additional object of the invention is to provide an apparatus which ensures uniform treatment of both major surfaces of photographic material.

One feature of the invention resides in the provision of an apparatus for treating photographic material. The apparatus comprises a first pair of advancing rollers and a second pair of advancing rollers spaced apart from and defining with the first pair a substantially horizontal path for photographic material. Each pair of advancing rollers includes an upper roller and a lower roller. The apparatus further comprises wall means, including upper and lower wall means (e.g. walls or sets of rolls) defining with the rollers an enclosed treating chamber.

Means are also provided for admitting treating liquid into the chamber at about the level of the path and in a direction transversely thereof, and liquid-retaining elements (lips or contact rolls) extend from the lower wall means to the nearest lower advancing roller to engage the latter along the entire axial length thereof.

The novel apparatus renders it possible to employ a very simple treating chamber. In fact, the chamber may constitute an injection-molded part made of a suitable synthetic plastic material. However, if photographic materials having a width of more than 400 mm width are to be treated, the chamber may be made of other material, such as V 4 A steel, to enhance its resistance to deformation.

The volume of the chamber is or may be small in spite of the fact that the apparatus can properly treat both sides of photographic material. A small-volume chamber requires a small container or reservoir (with a capacity of less than 1.25 liter) and, consequently, a small circulating pump can be used. The entire installation can be very energy-efficient.

The novel features which are considered as characteristic of the invention are set forth in particular in the appended claims. The improved apparatus itself, however, both to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
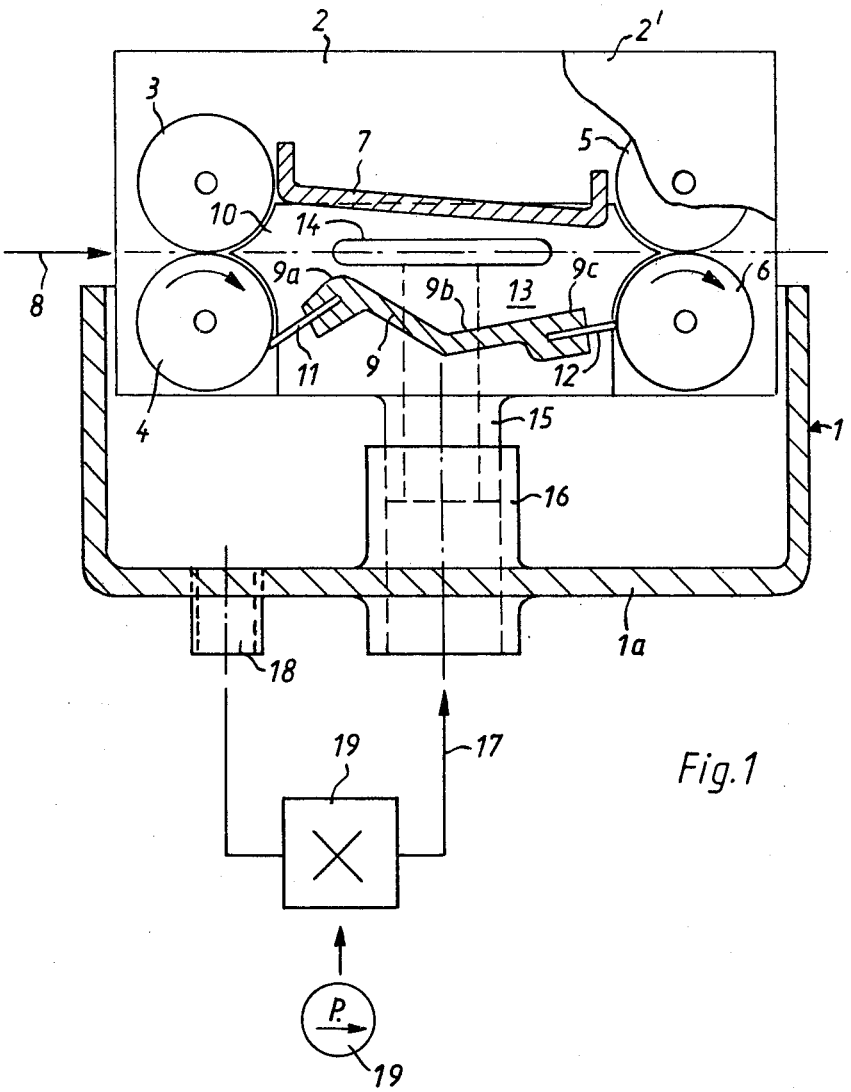
FIG. 1 is a somewhat diagrammatic vertical sectional view of one embodiment of the improved apparatus.

In FIG. 1, the reference character 1 denotes a container for supporting walls 2 and 2'. Photographic material to be treated advances between the walls 2 and 2' along a substantially horizontal path 8. A first pair of advancing rollers 3, 4 is mounted in and between the walls 2, 2' at the inlet side of the apparatus, and a second pair of advancing rollers 5, 6 is mounted at the outlet side of the apparatus.

An upper wall 7 is located between the supporting walls 2, 2' and intermediate the advancing rollers 3, 5; it is inclined with reference to the path 8 in a direction downwardly and toward the roller 5 so that air entering with the photographic material a treating chamber 13 below the upper wall 7 can readily escape. This largely avoids the danger of oxidation, especially when a developing bath is involved.

In addition to the upper wall 7, a lower wall 9 is mounted between the supporting walls 2, 2' and intermediate the lower advancing rollers 4, 6. The lower wall 9 has a generally undulate shape. More specifically, downstream of the advancing roller 4, the lower wall 9 has a narrow raised ridge or rib **9*a* which is followed, in a direction toward the advancing roller 6, by a depression 9*b* extending over a substantial portion of the length of the treating chamber 13. That end portion of the lower wall 9 which is nearest to the advancing roller 6 is denoted by the numeral 9*c* and rises toward the advancing roller 6 from the depression 9*b*. The purpose of the just described configuration of the wall 9 is to ensure that photographic material entering the nip of the advancing rollers 3, 4 will be lifted by liquid above the ridge 9*a* and guided along a substantially horizontal path. The depression 9*b* prevents contact between the photographic material and the lower wall 9 in the respective region (to avoid damage to the surfaces of the photographic material) and the rising portion 9c again lifts (by virtue of the liquid above it) the leading edge of the photographic material and guide it into the nip of the advancing rollers 5, 6**.

The front and rear ends of lower wall 9 have liquid-retaining lips 11, 12 which bridge the gaps between the respective ends of the wall 9 and the adjacent advancing rollers 4, 6. The lips 11, 12 engage the rollers 4, 6 over the entire axial length thereof. These lips consist of elastically yieldable material, such as natural or synthetic rubber or a synthetic plastic substance, and they make with the advancing rollers 4, 6 acute angles, i.e., angles smaller than 90°. The lips 11, 12 are inclined in the directions of rotation of the respective advancing rollers 4, 6. It can be said that the lips are substantially tangential to the adjacent lower rollers.

The sides of the treating chamber 13 are bounded by two side walls 10 (only one shown) each of which is located inwardly of one of the supporting walls 2, 2', respectively. The side walls 10 engage the upper and lower walls 7, 9 and the axial ends of the sealing lips 11, 12. Those edges of the side walls 10 which face toward the rollers 3, 4 and 5, 6 are contoured (provided with recesses or cutouts) complementary to the contours of the roller surfaces. The advancing rollers are partly received in the respective recesses, and the edges of the walls 10 are spaced from the roller surfaces by clearances having a width of only about 0.5 mm. The heretofore described construction ensures the formation of an almost fluidtight treating chamber 13.

The walls 2 and 10 are provided with inlet openings 14 for the treating liquid. The supporting wall 2' and the non-illustrated second wall 10 are provided with corresponding outlet openings (not shown) which discharge into the container 1. A conduit 15 is located outside the chamber 13 and connects the inlet opening 14 with a nipple 16 provided in the bottom wall 1a of container 1; the nipple 16 communicates with an opening 18 provided in the bottom wall 1a and serving to discharge liquid from the chamber 13 into a conduit or pipe 17 connected with the nipple 16 and containing a circulating pump 19.

In operation of the apparatus shown in FIG. 1, the pump 19 draws liquid from the container 1 and readmits it via inlet opening 14 so as to fill the chamber 13. The volume of the chamber 13 is very small so that the liquid flows transversely of the path 8 at a relatively high speed. Due to such small volume of the chamber 13, the container 1 need not have a volume in excess of 1.5 liter even if the photographic material has a width of 50 or 60 cm. Accordingly, the capacity of the pump 19 is small, i.e., the apparatus can employ a simple and inexpensive pump so that the arrangement is energy-efficient.

Figure 2:
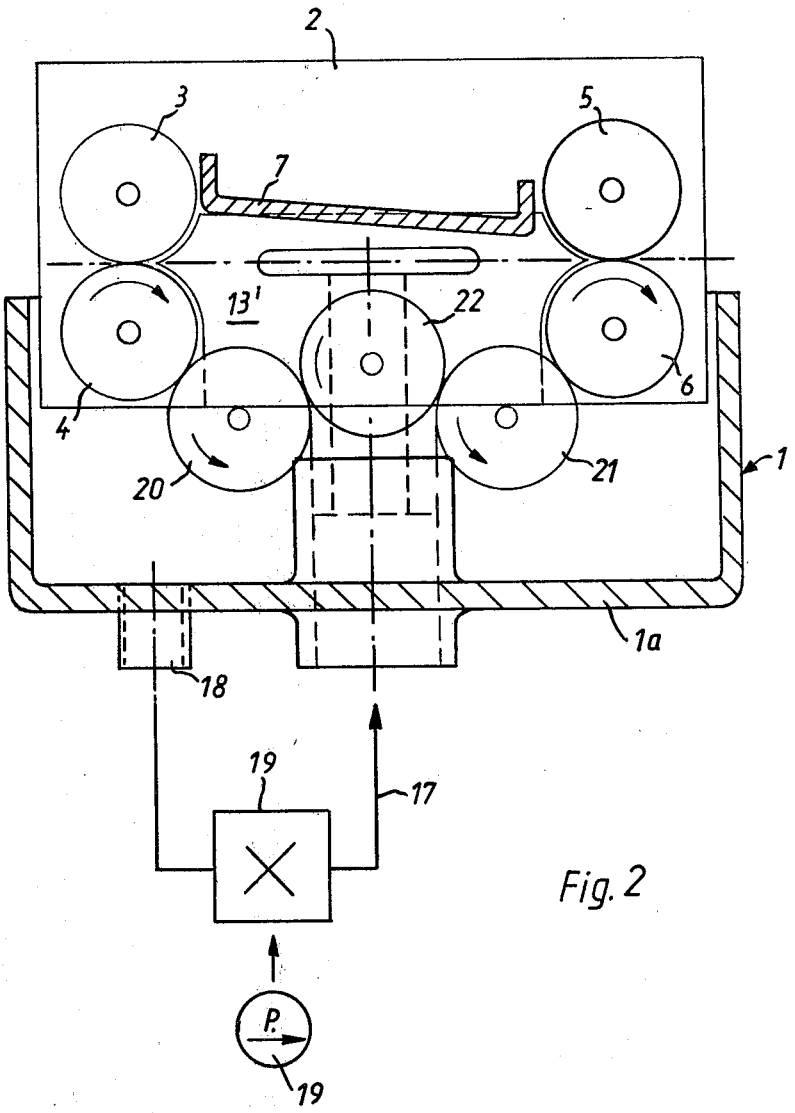
FIG. 2 is a view similar to that of FIG. 1 but showing a modified apparatus.

The embodiment of FIG. 2 is similar to that of FIG. 1, and like reference numerals are used therein to designate like parts.

The difference between the two embodiments is that the lower wall 9 and lips 11, 12 of FIG. 1 are replaced in FIG. 2 by three rolls 20, 21, 22 which contact one another and constitute the lower boundary of the treating chamber 13'. The roller 20 contacts the roller 4 and the roller 21 contacts the roller 6; thus, the rollers 20, 21 perform the functions of the lips 11, 12. The effect is the same as in the embodiment of FIG. 1.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

We claim:

1. Apparatus for treating photographic materials, particularly film sheets, comprising a first pair of advancing rollers and a second pair of advancing rollers, said pairs of rollers defining a substantially horizontal path for photographic material to be treated, and each pair including an upper roller and a lower roller; walls including upper and lower wall means and defining with said advancing rollers an enclosed treating chamber; means for admitting treating liquid into said chamber at about the level of and in a direction transverse to said path; and a pair of liquid-retaining elements each extending from said lower wall means to one of said lower rollers and engaging the latter substantially along the entire axial length thereof.

2. Apparatus as defined in claim 1, wherein said elements are lips extending from said lower wall means.

3. Apparatus as defined in claim 2, wherein said lips consist of elastically yieldable material.

4. Apparatus as defined in claim 2, wherein said lips and the peripheries of the respective lower rollers make angles of less than 90°.

5. Apparatus as defined in claim 2, wherein said lips are inclined relative to the respective lower rollers in the direction of rotation of each lower roller.

6. Apparatus as defined in claim 2, wherein said first pair of advancing rollers is located upstream of said second pair, as considered in the direction of advancement of photographic material, said lower wall means having an upper surface provided in the region of said first pair with a raised portion and downstream thereof with a depression and thereafter with a portion which rises toward said second pair.

7. Apparatus as defined in claim 1, wherein said lower wall means includes at least one first roll intermediate said lower rollers, said elements comprising two contact rolls each engaging said first roll and a different one of said lower rollers.

8. Apparatus as defined in claim 1, wherein said walls further include lateral walls having edges provided with recesses receiving and closely conforming to the contours of said rollers.

9. Apparatus as defined in claim 8, wherein said edges and said rollers define clearances having a width of about 0.5 mm.

10. Apparatus as defined in claim 8, wherein said admitting means includes an inlet opening provided in one of said lateral walls.

11. Apparatus as defined in claim 10, further comprising a container for treating liquid, said container communicating with said treating chamber, a circulating pump and conduit means connecting said pump with said container and with said inlet opening, respectively.

* * * * *